United States Patent [19]

Dalmau Guell

[11] 4,196,599

[45] Apr. 8, 1980

[54] NEEDLE SELECTION MECHANISM FOR KNITTING MACHINES

[75] Inventor: Jose M. Dalmau Güell, Barcelona, Spain

[73] Assignee: Jumberca, S. A., Barcelona, Spain

[21] Appl. No.: 16,305

[22] Filed: Feb. 28, 1979

[30] Foreign Application Priority Data

Mar. 4, 1978 [ES] Spain ..... 467.573
Mar. 4, 1978 [ES] Spain ..... 467.574

[51] Int. Cl.[2] ..... D04B 7/00; D04B 15/66
[52] U.S. Cl. ..... 66/75.2; 66/220
[58] Field of Search ..... 66/75.2, 233 X, 232, 66/218, 219 X, 220, 221

[56] References Cited

U.S. PATENT DOCUMENTS

| | | | |
|---|---|---|---|
| 1,795,235 | 3/1931 | Ruinnet | 66/75.2 |
| 1,797,006 | 3/1931 | Lombardi | 66/241 X |
| 3,667,254 | 6/1972 | Paepke | 66/221 |
| 3,710,594 | 1/1973 | Bourgeois | 60/220 |
| 3,733,855 | 5/1973 | Bliss-Hill et al. | 66/219 |
| 3,890,805 | 6/1975 | Bourgeois | 66/220 |
| 3,974,664 | 8/1976 | Erb | 66/75.2 |

FOREIGN PATENT DOCUMENTS

| | | | |
|---|---|---|---|
| 24031 | 10/1962 | German Democratic Rep. | 66/75.2 |
| 809157 | 2/1959 | United Kingdom | 66/222 |

*Primary Examiner*—Ronald Feldbaum
*Attorney, Agent, or Firm*—Staas & Halsey

[57] ABSTRACT

A selection mechanism for knitting machines in which each raising jack for lifting the needles is associated with a pusher jack which is placed opposite the poles of an electromagnetic array during each selection cycle. This array either holds the pusher jack, whereby it is held out of the scope of action of cams which apply it against the corresponding raising jack or does not hold it, so that said pusher jack is selected by one of the above cams. The holding or non-holding of the pusher jack is determined by a program unit which selectively energizes the coils of the electromagnetic array.

5 Claims, 12 Drawing Figures

NEEDLE SELECTION MECHANISM FOR KNITTING MACHINES

FIELD OF THE INVENTION

The invention relates to a needle selection mechanism for knitting machines, of the type in which the needle raising stage is effected by a raising jack and the needle drawdown and knitting stages are effected by a butt associated with the needles, the knitting machine being equipped possibly with a plurality of selection sets.

The invention may be applied both to selection mechanisms mounted in circular knitting machines and to selection mechanisms mounted in flat knitting machines. In either case, it is possible to perform needle inactivation, activation, and tuck stages within one same selection set and it is also possible to reach the transfer position in purl stitch or links and links machines.

SUMMARY OF THE INVENTION

The invention provides a selection mechanism which comprises a pusher jack made of magnetic material for each raising jack. Each pusher jack has an edge portion at one of its ends, an intermediate butt and a tail portion at the other end. Said pusher jack is adapted for being moved lengthwise from a first end position in which said edge portion engages the corresponding raising jack to a second end position and vice versa. The said pusher jack is also provided with resilient means biassing said tail portion to a mechanically stable transverse position.

The selection system also comprises an electromagnetic array having for each pusher jack a magnet, the poles of which are opposite said tail portion when the pusher jack is in said second end position. Each magnet is associated with an independently controlled coil causing the corresponding magnet to attract or not.

The said system also comprises a cancellation cam for each selection set adapted to engage the pusher jack butts and move them lengthwise to said second end position thereof, in which the tail portions of the jacks are opposite the respective poles of said electromagnetic array.

There is also a cocking cam for each selection set, adapted to overcome said resilient means of the pusher jacks when the latter are in the said second end position thereof, whereby the tail portion thereof is moved out of said mechanically stable transverse position to be releasably applied against the poles of the respective magnets of said electromagnetic array, and where they are held when the respective magnet is in an attracting state. If the respective magnet is not in an attracting state, the tail portion is not held.

The selection system is further provided with a set of cams for each working set, adapted for engaging the butt of said pusher jacks when the respective tail portions thereof are not held by the magnets, thereby moving them lengthwise towards the said first end position thereof, in which said edge portion engages the corresponding raising jack.

BRIEF DESCRIPTION OF THE DRAWINGS

Further objects and features of the invention will be disclosed in detail in the following description, with reference to the accompanying illustrative drawing, in which.

DETAILED DESCRIPTION OF THE INVENTION

Figure 1:
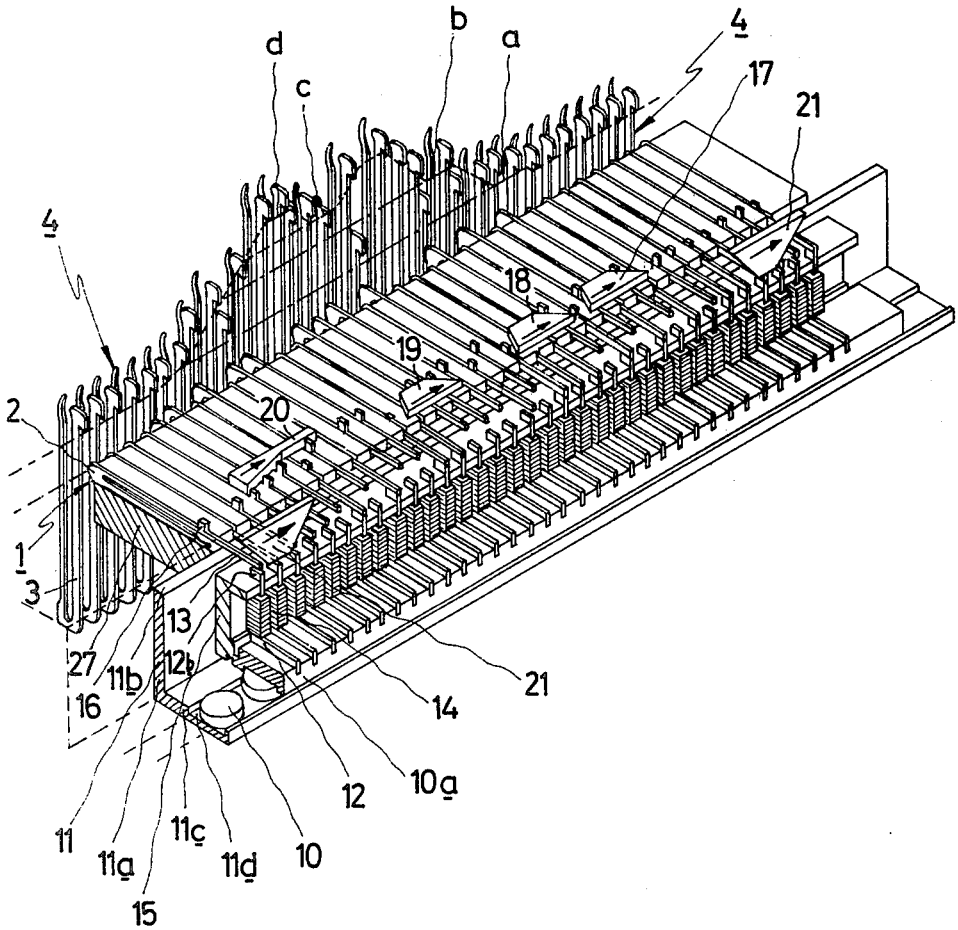
FIG. 1 is a perspective view, partly in section, of a selection set corresponding to a selection mechanism for a links and links type flat knitting machine.

A selection mechanism for knitting machines, both circular (FIG. 2) and flat (FIG. 1), according to the invention comprises pushing means in the form of pusher jacks 1 made from magnetic material, located horizontally in the embodiment illustrated, the edge portion 2 of which is engageable with the front arm 3 of the respective raising jacks 4. The raising jacks 4 act directly upon needles having a single head and butt (not shown in the drawing), or on intermediate jacks or sliders 5 having a butt and acting in turn on double headed needles 6 not having butts, located in the needle cylinder 7 or, in the case of the flat knitting machines, in the needle bed. Such needles are controlled through the butts thereof or the butts of the sliders by the corresponding drawdown and stitch cams 8. In turn, the said raising jacks 4 are controlled by the raising cams 9.

Figure 2:
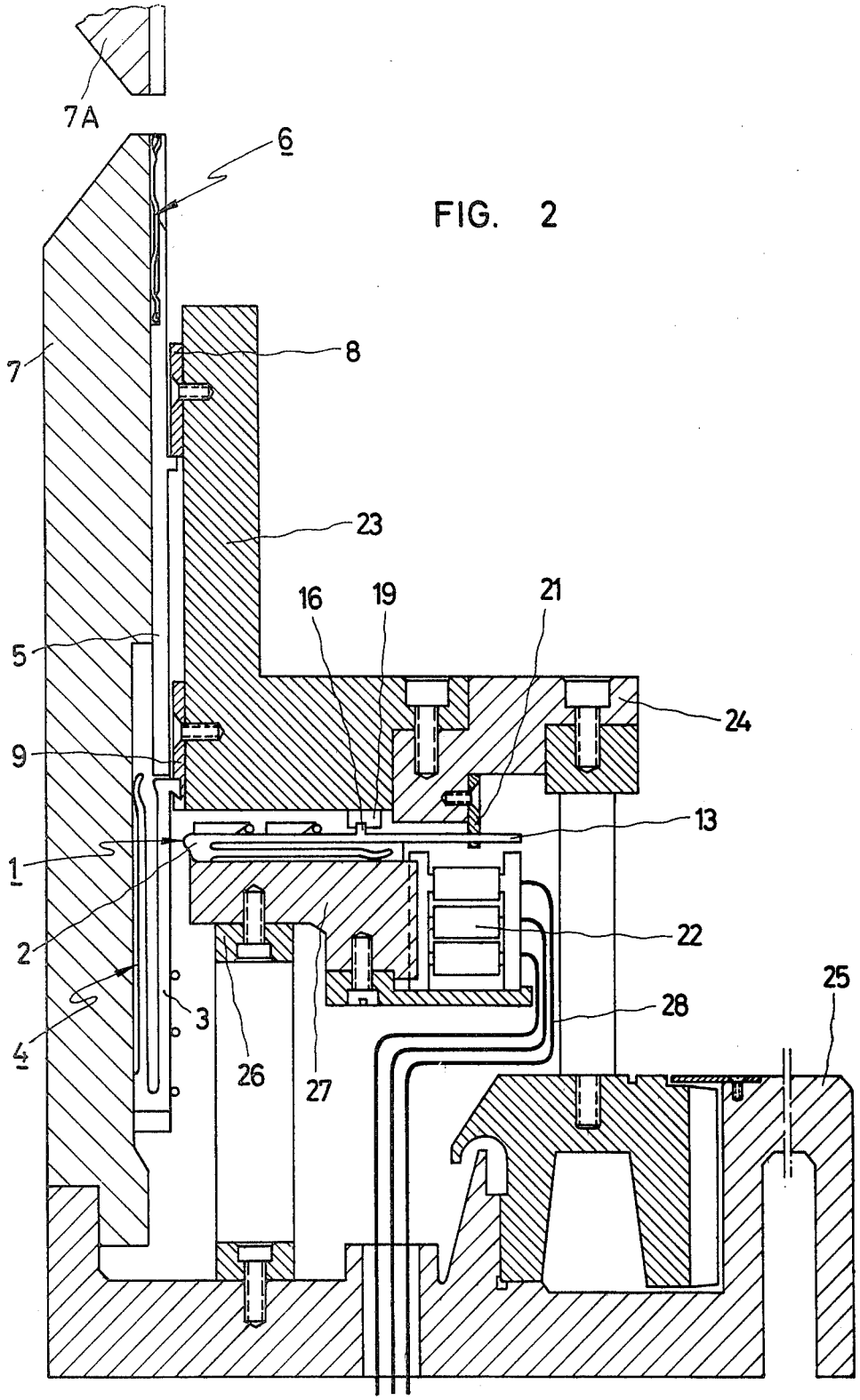
FIG. 2 is a radial section of a selection mechanism as used in a links and links type circular knitting machine.

In circular links and links knitting machines, the double headed needles 6 work in one or the other of two axially disposed needle cylinders 7 and 7A, as seen in FIG. 2, transfers of needles from one cylinder to the other taking place to knit face or back fabric.

The pusher jacks 1 are provided with a butt 16 and a tail portion 13 extending therefrom in the opposite direction to the edge portion 2 and are provided also with resilient means biassing said tail portion to a mechanically stable transverse position, as shown in FIGS. 4, 6, 8 and 10, although by means to be described hereinafter, they may be releasably held in a further position, such as illustrated in FIGS. 3, 5, 7, 9, 11 and 12. These resilient means may be constituted by forming the jack as a resilient fork as shown in the FIGS.

Said jacks 1 are supported by the base plate 27 and are adapted for lengthwise movement between a first end position in which the edge portion 2 thereof engages with the corresponding raising jack 4 and a second end position in which the tail portion 13 thereof is adapted for engagement with poles **11*b* and 12*b***, as will be described hereinafter.

The electromagnetic array shown in FIG. 1 is constituted by an L-shaped member 11 of magnetic material, having an upright leg **11*a* forming a continuous pole 11*b* and a horizontal leg 11*c* having a slot 11*d* wherein there is housed a plurality of permanent magnets 10, situated in such a way that all the positive poles and all the negative poles are oriented in the same direction. Over said leg 11*a* there is disposed the member 10*a*, also of magnetic material and likewise having a slot, said member 10*a* serving to even out the puntual magnetic effect of said permanent magnets 10**.

Inlaid in member **10*a*, there are L-shaped platelets 12 of magnetic material having a front leg 12*a* providing the individual pole 12*b*. Between the platelets 12 and leg 11*a* of the L-shaped member 11 there is a body 15 of non-magnetic material, preferably bronze, aluminum or similar material. This arrangement provides a plurality of magnets, each formed by a platelet 12 and the L-shaped member 11**.

Pole 11*b* and each of poles 12*b* are so arranged that they may be engaged by the tail portion 13 of the pusher jacks, in which case the magnetic circuit between said poles is closed, whereby they retain the said tail portion in the releasable application position thereof.

In each of said legs 12*a* there is disposed a coil 14 for creating a magnetic field of identical intensity and opposite polarity to the magnetic field created by the permanent magnets 10. This coil 14 is so activated through a programming equipment that at the desired time the attraction of the poles 11*b* and 12*b* is counteracted and cancelled out, whereby the tail portion 13 ceases to be attracted and recovers its mechanically stable transverse position.

Each of the butts 16 of the pusher jacks 1 may be engaged by cams of a first set, comprising an inactivating cam 17, a tuck cam 18 and an activating cam 19, plus a cancellation cam 20, adapted to move the said pusher jacks 1 lengthwise towards the two end positions thereof, whereby they move in the direction of the arrows, the cams 17, 18 and 19 pushing against the rear edge of the butt 16, to move it towards the raising jacks 4, whereas the following cancellation cam 20 pushes against the front edge of the said butt 16 to carry the pusher jacks 1 opposite the poles 11*b* and 12*b* of the electromagnetic array.

On the other hand, a cocking cam 21 acts vertically on the tail portions 13 of the jacks 1 to move them from their mechanically stable transverse position and releasably apply them against the said poles 11*b* and 12*b* of the electromagnetic array.

By controlling the needles 6, the knitting process is determined by the movement of the cams 17, 18 and 19 which act on the butts 16 of the pusher jacks 1, whereby the latter so move the raising jacks 4 that these may be held, respectively, in the inactive, tuck and active positions, with possible passage to transfer if none of the said cams is operative.

These movements of the raising jacks 4 are shown in FIG. 1 by paths drawn with dot and dash lines and referenced with the letters a for inactive, b for tuck and c for active, the transfer path having been marked with d.

Conversely, the cancellation cam 20 moves the pusher jacks 1 back to their second end position in which the tail portions 13 thereof are opposite the poles 11*b* and 12*b* so that, in due time, the cocking cam 21 may move them from the stable to the releasable position thereof, that is, by applying the tail portion 13 thereof to said poles 11*b* and 12*b* so that they may be held by the attraction of the magnets of the electromagnetic array.

The selection process is initiated by energising the coils 14 of the electromagnetic array by external, program controlled means, to overcome the magnet action and restore the jacks 1 to the stable position thereof, in which they are in position to be engaged by one of the operative cams 17, 18 and 19.

The energising signals for the coils 14 must be outputted synchronously with the movement of the different selection sets and precisely in the space between the pairs of cams 20–17, 17–18 and 18–19, according to the selection position required for each needle 6. Consequently, the diverse pusher jacks 1 may be activated at any time and be engaged by any of the cams 17, 18 and 19 and, subsequently, by the remaining cancellation cam 20 and cocking cam 21.

Thus, a complete selection cycle is developed in the space comprised between two consecutive cancellation cams 20.

In FIG. 2 there is illustrated an embodiment relating to a links and links knitting machine in which the action to hold the pusher jacks 1 in the releasable position thereof and to move them selectively to the stable position thereof is determined in this case directly by an electromagnetic array formed by electromagnets 22. Also shown in this FIG. are the support 23 for the drawdown and stitch cams 8 and raising cams 9. Said support 23 is provided with an additional member 24 for holding the cocking cam 21, the above group, including the cylinder 7, being supported on a frame 25 on which there is supported the base plate 27 for the pusher jacks 1 by way of a bridge member 26.

The electromagnets 22 are activated from the corresponding program centre by circuits 28.

In FIGS. 3 through 12, there is illustrated the succession of stages of a selection cycle of the links and links machine illustrated in FIG. 1.

Figure 3:
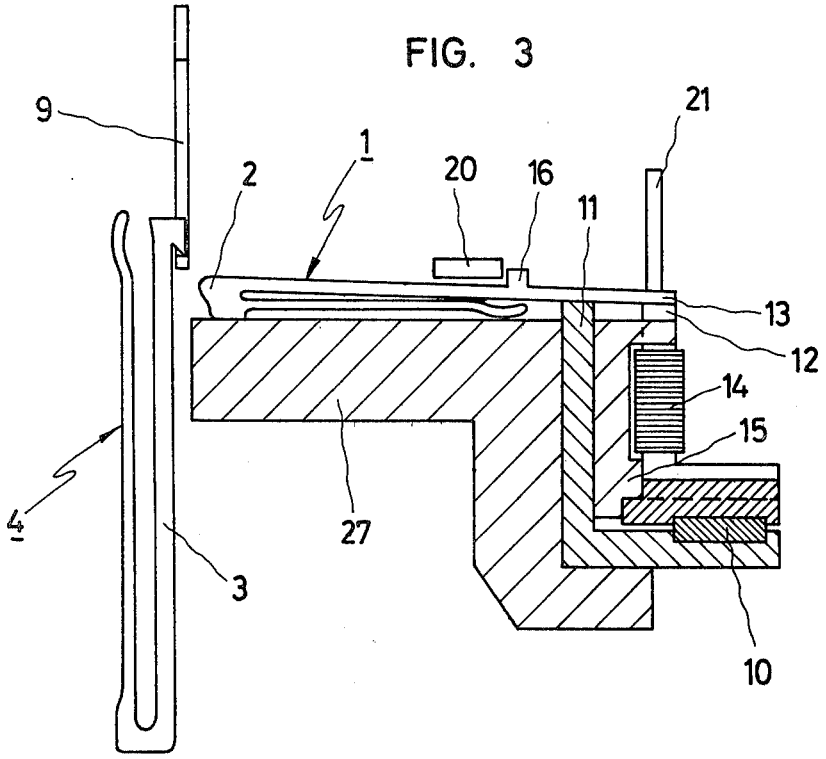
FIGS. 3 through 12 are diagrams of the different stages of an operative cycle, showing the positions which may be reached by a pusher jack in terms of the established program and of the members associated therewith.

FIG. 3 shows the starting position for a selection set. This starting position corresponds to the cocking position of all the pusher jacks 1 under the effect of the cocking cam 21 after all the pusher jacks 1 have been placed with the tail portions 13 thereof opposite to the poles 11*b* and 12*b* of the electromagnetic array by the effect of the cancellation cam 20. In this position, the raising jacks 4 are in their lowermost position and ready to be engaged by the raising cam 9. To simplify the Figures, neither the sliders 5 nor the needles 6 have been shown. They have not been shown either in the FIG. 1.

Figure 4:
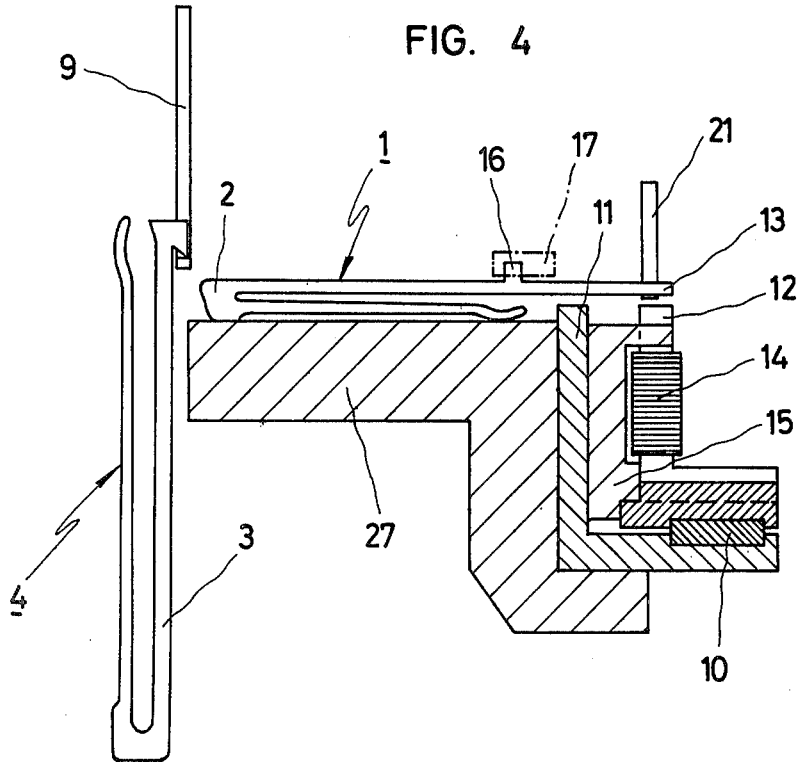

If the coil 14 is energised in the FIG. 3 position, the tail portion 13 of the pusher jacks 1 will not be held by the poles 11*b* and 12*b* of the electromagnetic array and will reach the stage shown in FIG. 4 in which it is seen that the cocking cam 21 has already passed and the inactivating cam 17 (shown in dotted line) is approaching the butt 16 of the pusher jack 1, while the raising jack 4 is still in the lowermost position thereof, since the raising cam 9 has not engaged therewith.

Figure 6:
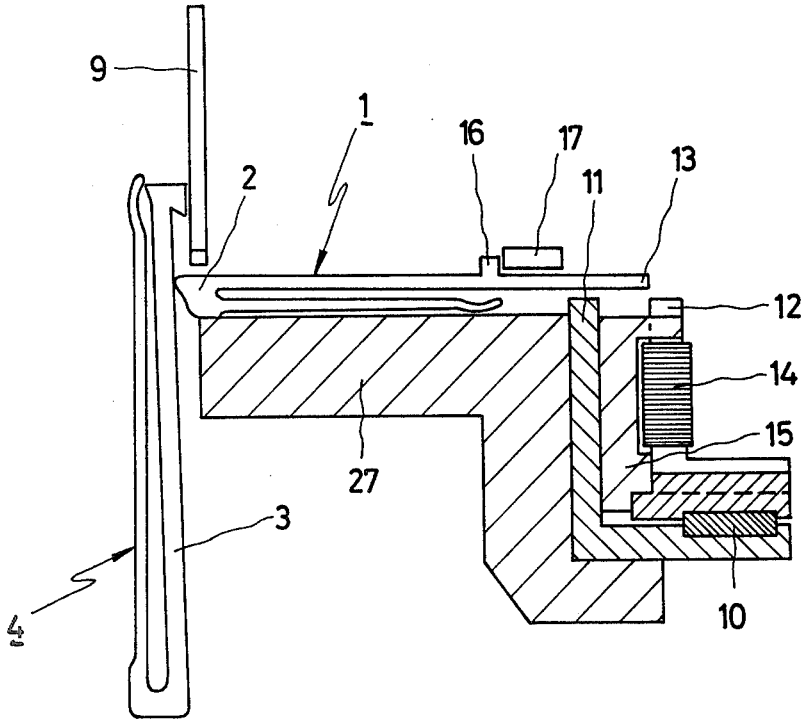

When the inactivating cam 17 reaches the butt 16 of the pusher jack 1, as seen in FIG. 6, said cam 17 pushes the said pusher jack 1 and the latter acts on arm 3 of the raising jack 4, moving it out of the path of the raising cam 9 which had already started to raise said raising jack, whereby the latter is left at the height shown and, consequently, the corresponding needle remains in the inactive position following path a in FIG. 1.

Figure 5:
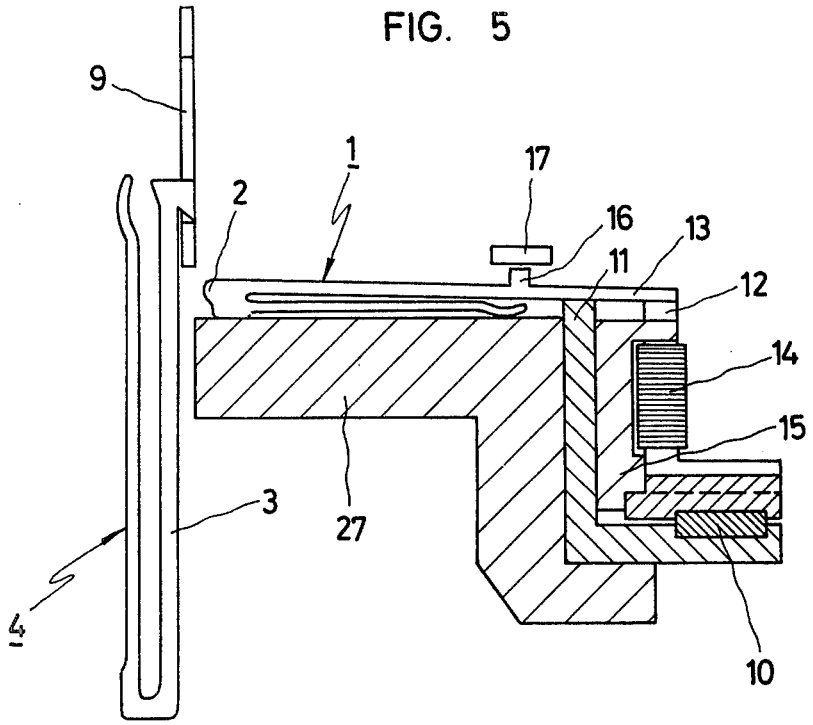

Conversely, if the coil 14 is not energised in the FIG. 3, position the tail portion 13 of the pusher jacks 1 will be held by the poles 11*b* and 12*b* of the electromagnetic array and will give rise to the position of FIG. 5, where the inactivating cam 17 moves beyond the butt 16 of the pusher jack 1, without engaging therewith, while the raising jack 4 starts to rise under the effect of the raising cam 9.

Figure 7:
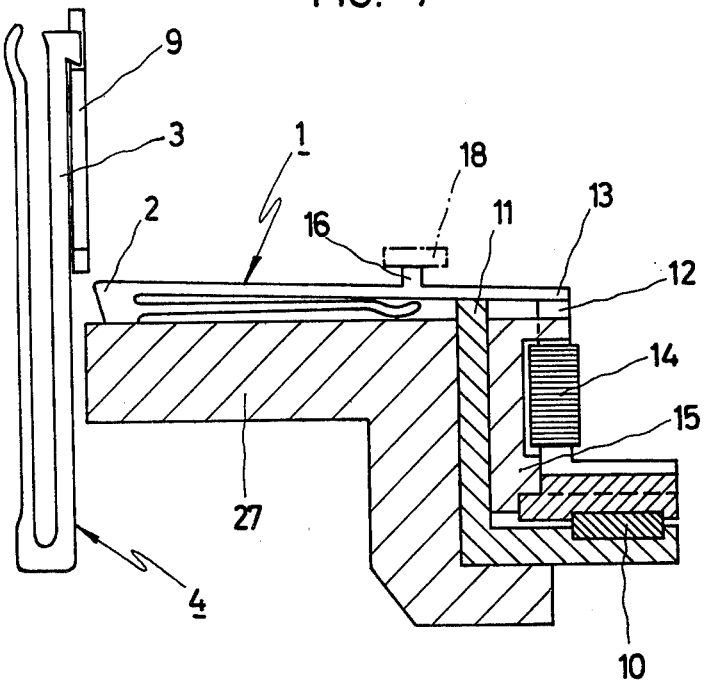

Continuing in the foregoing situation, the FIG. 7 position is reached wherein the tuck cam 18 (shown in dotted line) approaches the butt 16 of the pusher jack 1, at the same time as the raising jack 4 has reached the tuck height for the corresponding needle.

Figure 8:
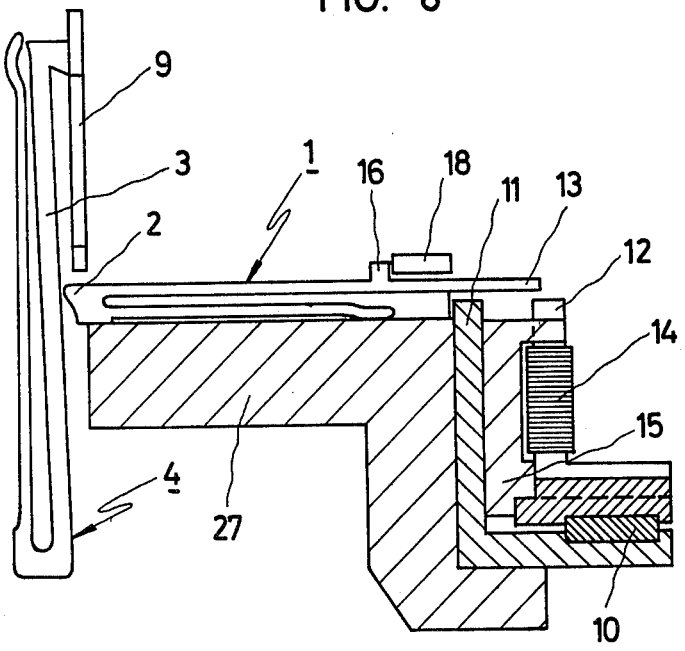

When the coil 14 is energised in the FIG. 7 position, the tail portion 13 of the pusher jack 1 is released and the butt 16 is engaged by the tuck cam 18, as seen in FIG. 8, thereby moving the pusher jack 1 against the arm 3 of the raising jack 4. The raising jack 4 then remains at the height corresponding to the tuck position of the corresponding needle, as shown by the path b in FIG. 1, on having been pushed out of the track of the raising cam 9.

Figure 9:
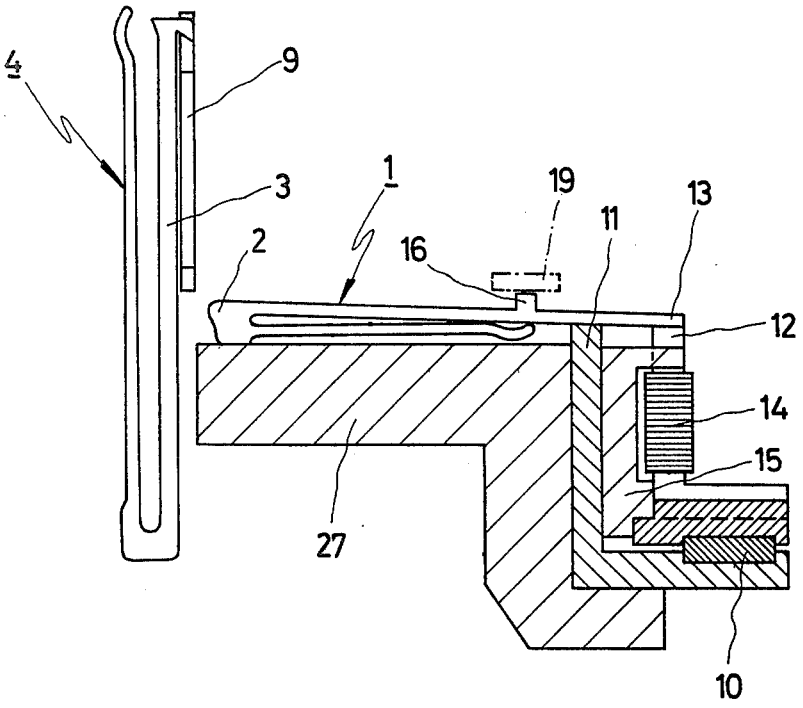

On the other hand, if the coil 14 is not energised in the FIG. 7 position, the tuck cam 18 moves beyond the butt 16 of the pusher jack 1 and, as seen in FIG. 9, the activating cam 19 (shown in dotted line) approaches the butt 16 of the said pusher jack 1, at the same time as the raising jack 4 reaches the active height and may continue, as in the present embodiment of a links and links machine, to the needle transfer position, following in such case the path marked with d in FIG. 1.

Figure 10:
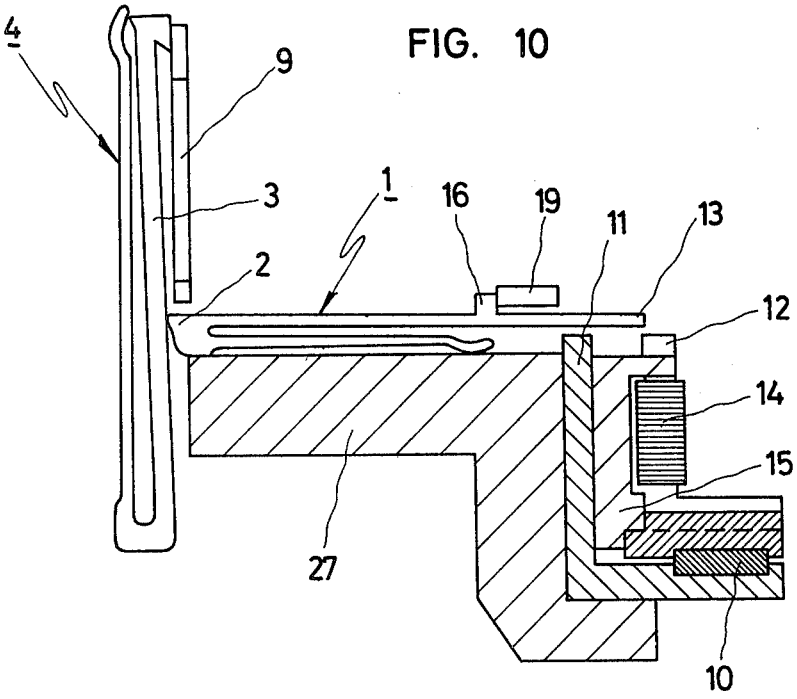

When the coil 14 is energised in the FIG. 9 position, the tail portion 13 of the pusher jack 1 is released from the electromagnetic array, whereby the butt 16 is engaged by the activating cam 19, as seen in FIG. 10, whereby the said pusher jack 1 engages arm 3 of the raising jack 4 and separates it from the track of the raising cam 9 at its active height, following path c in FIG. 1.

Figure 11:
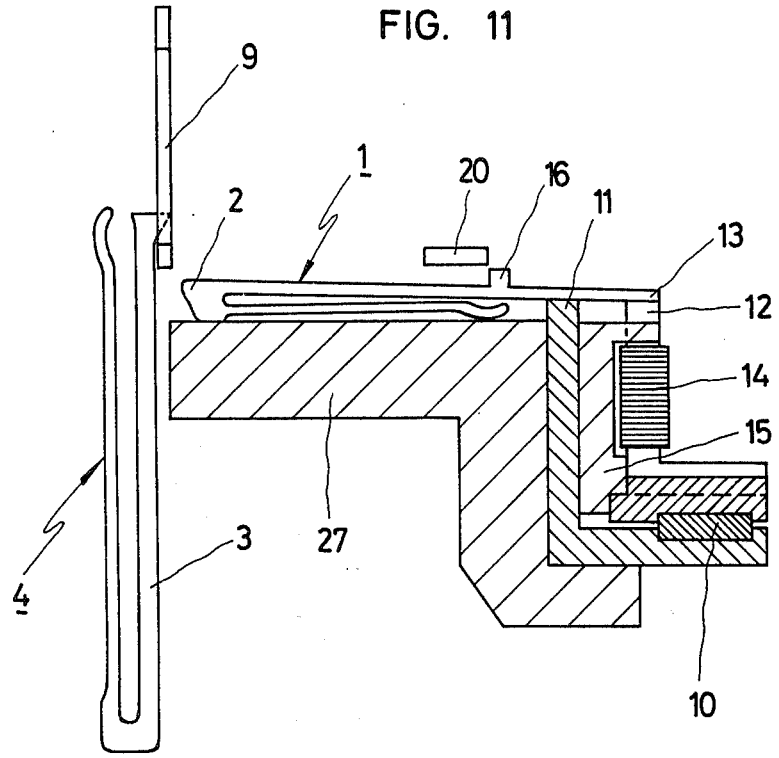
Figure 12:
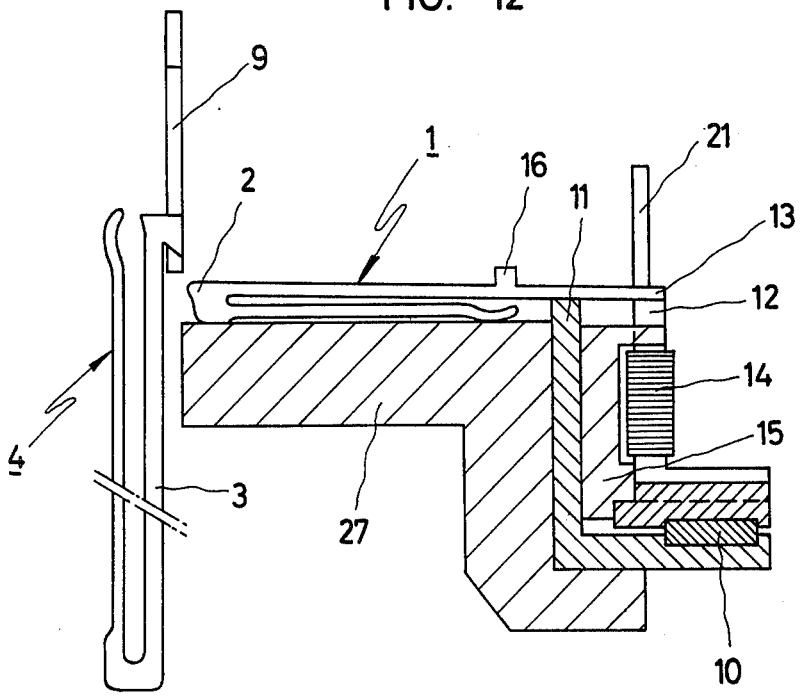

If, on the other hand, the coil 14 is not energised in the FIG. 9 position, the FIG. 11 position is reached, in which the raising jacks 4 have moved to the lowermost position thereof, under the effect of the drawdown and stitch cams and the pusher jacks 1 which have previously been engaged by the cams 17, 18 or 19 are now engaged by the cancellation cam 20 and so moved that the tail portions 13 thereof are opposite the poles **11*b* and 12*b* of the electromagnetic array and in the same position as the pusher jacks 1 not engaged by said cams, namely, those which have not been released from the electromagnetic holding as seen in FIG. 3 starting position, all of the pusher jacks 1 not already having the tail portion 13 thereof applied against the electromagnetic array, being applied thereagainst by the cocking cam 21 as shown in FIG. 12**.

With a view to summarising the succession of diverse stages or situations illustrated in FIGS. 3 through 12, described in detail in the foregoing paragraphs, the said succession is represented schematically below:

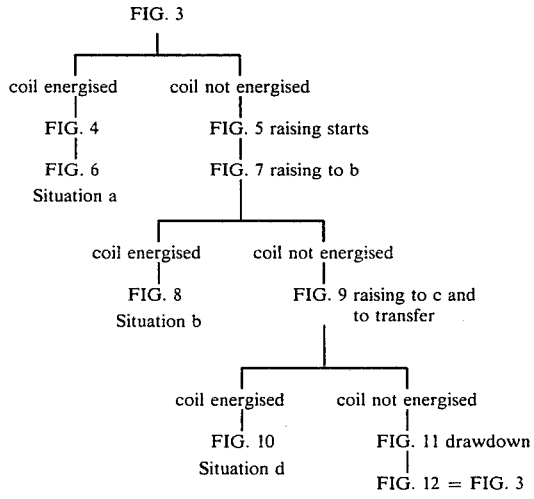

Further to the foregoing description, the operative cycle may be resumed as follows:

(a) all the pusher jacks 1 are situated in the cocking position by cancellation cam 20.

(b) all the pusher jacks 1 are applied by the cocking cam 21 against the poles of the corresponding electromagnetic array and are held when said array is in an active state, namely, with coils 14 deenergised and are not held when the said array is in an inactive state, that is, with coils 14 energised.

(c) the pusher jacks 1 which are held are not engaged by the inactivating, tuck and activating cams while they are being held.

(d) any pusher jack 1 being held may be released in the space preceeding each cam 17, 18 or 19 and be engaged by the corresponding cam to locate the raising jack 4 in the inactive, tuck or active position.

(e) the pusher jacks 1 held during the passage of a working set do not act on the raising jack 4 and the latter, under the effect of the raising cam 9, raises the corresponding needle to the transfer position after passing through the tuck and active positions.

(f) the pusher jacks 1 which are not held from the start of the passage of a working set are engaged by the inactivating cam 17 and push the raising jacks 4, whereby the latter are separated from the path of the raising cam 9 and the corresponding needles 6 remain inactive.

(g) the pusher jacks 1 held during the passage of the inactivating cam 17 and freed immediately after the passage thereof, are engaged by the tuck cam 18 and the raising jacks 4 are separated from the raising cam 9 at the tuck level of the needles 6.

(h) the pusher jacks 1 held during the passage of the inactivating cam 17 and tuck cam 18 and released immediately after the passage of the latter are engaged by the activating cam 19 and the raising jacks 4 are separated from the raising cam 9 at the active height of the needles 6.

(i) all the pusher jacks 1 which have been engaged by any of the inactivating cam 17, tuck cam 18 and activating cam 19 are engaged by the cancellation cam 20 which moves them to the cocking position together with those jacks which have been held throughout the passage of the working set, where they are engaged by the cocking cam 21.

What I claim is:

1. In needle selection mechanisms for knitting machines, of the type in which the needle raising stage is effected by a raising jack and the needle drawdown and knitting stages are effected by a butt associated with the needles, the knitting machine being equipped possibly with a plurality of selection sets, the improvement comprising:

a pusher jack, made of magnetic material, for each raising jack, each said pusher jack being provided with an edge portion at one end, an intermediate butt and a tail portion at the other end, said pusher jack being adapted to be moved lengthwise from a first end position in which said edge portion engages the corresponding raising jack to a second end position and vice versa, said jack being provided also with resilient means biassing said tail portion to a mechanically stable transverse position;

an electromagnetic array being provided for each jack with a magnet, the poles of which are opposite said tail portion when the pusher jack is in said second end position each magnet being associated with an independently controlled coil causing the corresponding magnet to attract or not to attract;

a cancellation cam for each selection set adapted to engage the butt of the pusher jacks and move them lengthwise to said second end position thereof in which said tail portions of the jacks are opposite the respective poles of said electromagnetic array;

a cocking cam for each selection set, adapted to overcome the said resilient means of said pusher jacks when the latter are in the said second end position thereof, whereby the tail portion thereof is moved out of said mechanically stable transverse position to be releasably applied against the poles of the respective magnets of said electromagnetic array, to which they are attracted or not according to whether said magnet attracts or not;

a set of cams for each working set, adapted to engage the butt of the said pusher jacks when the respective tail portions thereof are not held by the magnets, moving them lengthwise to the said first end position thereof, in which said edge portion thereof engages the corresponding raising jack.

2. The improvement of claim 1, wherein the pusher jacks are resilient forks having a curved portion at one end and one of the arms thereof being provided with a butt and a tail portion integral with the arm extending therefrom.

3. The improvement of claim 1, wherein the electromagnetic array comprises an independently controlled electromagnet for each said pusher jack.

4. The improvement of claim 1, wherein all the magnets of the electromagnetic array have a common pole and moreover an individual pole, the common pole and each of the individual poles being adapted for engaging with the tail portion of one of the said pusher jacks when said tail portion is pushed by said cocking cam to move from the mechanically stable transverse position thereof to be applied there against, in which position it is held by the attraction of the respective magnet and each individual pole being associated with a coil which on being energised is adapted to create a magnetic field of equal intensity and opposite polarity to that of the individual magnet, whereby the attraction of the latter ceases and the tail portion returns to its stable position.

5. The improvement of claim 4, wherein each of the magnets is formed by a common L-shaped member of magnetic material, one of the legs of which determining the said common pole, while the other leg forms a housing for a plurality of permanent magnets so situated that all the positive poles and all the negative poles are oriented in the same direction, said housing being closed by a member also of magnetic material in which there are embedded a plurality of L-shaped platelets of magnetic material, each of them determining the individual pole of each magnet.

* * * * *